US005397043A

United States Patent [19]

Blanding

[11] Patent Number: 5,397,043

[45] Date of Patent: Mar. 14, 1995

[54] WEB TRACKING DEVICE WITH RAMP SUPPORT

[75] Inventor: Douglass L. Blanding, Rochester, N.Y.

[73] Assignee: Eastman Kodak Company, Rochester, N.Y.

[21] Appl. No.: 728,478

[22] Filed: Jul. 11, 1991

[51] Int. Cl.[6] ..... B65H 23/00

[52] U.S. Cl. ..... 226/21

[58] Field of Search ..... 226/3, 15, 18, 19, 21, 226/23

[56] References Cited

U.S. PATENT DOCUMENTS

| | | | |
|---|---|---|---|
| 3,973,446 | 8/1976 | Vasilantone | 226/21 X |
| 4,174,171 | 11/1979 | Hamaker et al. | 226/23 X |
| 4,197,002 | 4/1980 | Hamaker et al. | 226/97 X |

*Primary Examiner*—Daniel P. Stodola
*Attorney, Agent, or Firm*—Lawrence P. Kessler

[57] ABSTRACT

A web tracking device includes a tensioning and steering roller that is movable to apply tension to a web uniformly across its width and that can be tilted in response to the tendency of the web to drift laterally to steer the web and thereby maintain it within a predetermined path. The steering position of the roller is established by roller supporting structure including a support cooperating with a ramp such that the tilt of the roller is effected by relative lateral movement between the ramp and the support. The same elements of the roller supporting structure that define the steering position of the roller also at least partially support the roller to provide for the roller movement by which the web is uniformly tensioned.

5 Claims, 4 Drawing Sheets

WEB TRACKING DEVICE WITH RAMP SUPPORT

BACKGROUND OF THE INVENTION

1. Field of the Invention

The invention relates in general to web tracking devices of the type in which a tensioning and steering roller resiliently applies tension to the web uniformly across its width and is tilted in response to lateral movement of the web to steer the web and thereby maintain it within a predetermined path. More particularly, the invention relates to such a device in which the steering position of the roller is established by roller supporting structure including support means cooperating with ramp means such that the tilt of the roller is effected by relative lateral movement between the ramp means and the support means and in which the same elements of the roller supporting structure that define the steering position of the roller also at least partially support the roller to provide for the roller movement by which the web is uniformly tensioned.

2. Description Relative to the Prior Art

The type of web tracking device to which the present invention is directed is typically used in conjunction with an endless web or belt, for example, the endless photoconductor belt in an electrostatographic apparatus such as a copier or printer. In order to tension the belt, to compensate for belt conicity and to steer the belt to maintain it within its desired path, the tensioning and steering roller must have at least three degrees of freedom in addition to its freedom to rotate about its own axis: namely, one degree of translational freedom to allow the roller to move generally parallel to its axis to tension the belt; a first or tilting degree of rotational freedom to provide the required belt steering movement of the roller; and a second or skewing degree of rotational freedom to allow the roller to maintain equal tension across the width of the belt, thereby compensating for unavoidable inaccuracies resulting in belt conicity.

U.S. Pat. No. 4,893,740, issued in the name of Edwin A. Hediger et al. to the assignee of the present invention on Jan. 16, 1990, discloses a web tracking device of the general type described above, in which the steering roller is rotatably carried by a yoke that is pivotable about a steering or gimbal axis defined by a support rod rotatably and slidably mounted in a housing that, in turn, is pivotable about a caster axis. The support rod is spring loaded to urge the yoke away from the housing to tension the web and the movement of the entire assembly about the caster axis provides for uniform tension across the width of the web by allowing the roller to assume an angular position in which it can compensate for belt conicity.

The term "belt conicity" literally means that an endless belt is slightly conical, rather than being perfectly cylindrical, but, as used herein, the term means either that an endless belt or web is slightly conical or that a belt or web, whether endless of not, behaves as if it were endless and slightly conical, either because of inaccuracies in the belt or web per se or in other parts of the belt or web guiding or supporting mechanism. Although the term "web" is generally perceived as being more generic than the term "belt" and the latter sometimes implies endlessness, the two terms, as used herein, should be considered as interchangeable.

In the Hediger device, flanges at both ends of the steering and tensioning roller are axially movable with respect to that roller. When the web drifts laterally in either direction, it engages and displaces the flange at the corresponding end of the roller, and this, in turn, shifts a slidably movable yoke driver in the same direction. The yoke driver includes oppositely sloped slots engaged with corresponding pins extending from the yoke, whereby the lateral movement of the yoke driver causes the roller to tilt in the proper direction to counteract the drifting tendency of the web.

SUMMARY OF THE INVENTION

In accordance with the present invention, the steering and tensioning roller of a web tracking device is supported by support structure that is functionally similar to the Hediger device in that it includes roller support means cooperating with ramp means such that the tilt of the roller for steering the web is effected by relative lateral movement between the ramp means and the roller support means. However, unlike the Hediger construction, the same elements of the support structure that define the tilting web steering movement of the roller also at least partially support the roller to provide for the roller movement by which the web is uniformly tensioned. Accordingly, as compared to the Hediger device, the subject web tracking and tensioning mechanism is simpler, less expensive, more reliable and easier to adjust or replace.

Various means for practicing the invention and other advantages and novel features thereof will be apparent from the following detailed description of illustrative preferred embodiments.

DETAILED DESCRIPTION OF THE PREFERRED EMBODIMENTS

Figure 1:
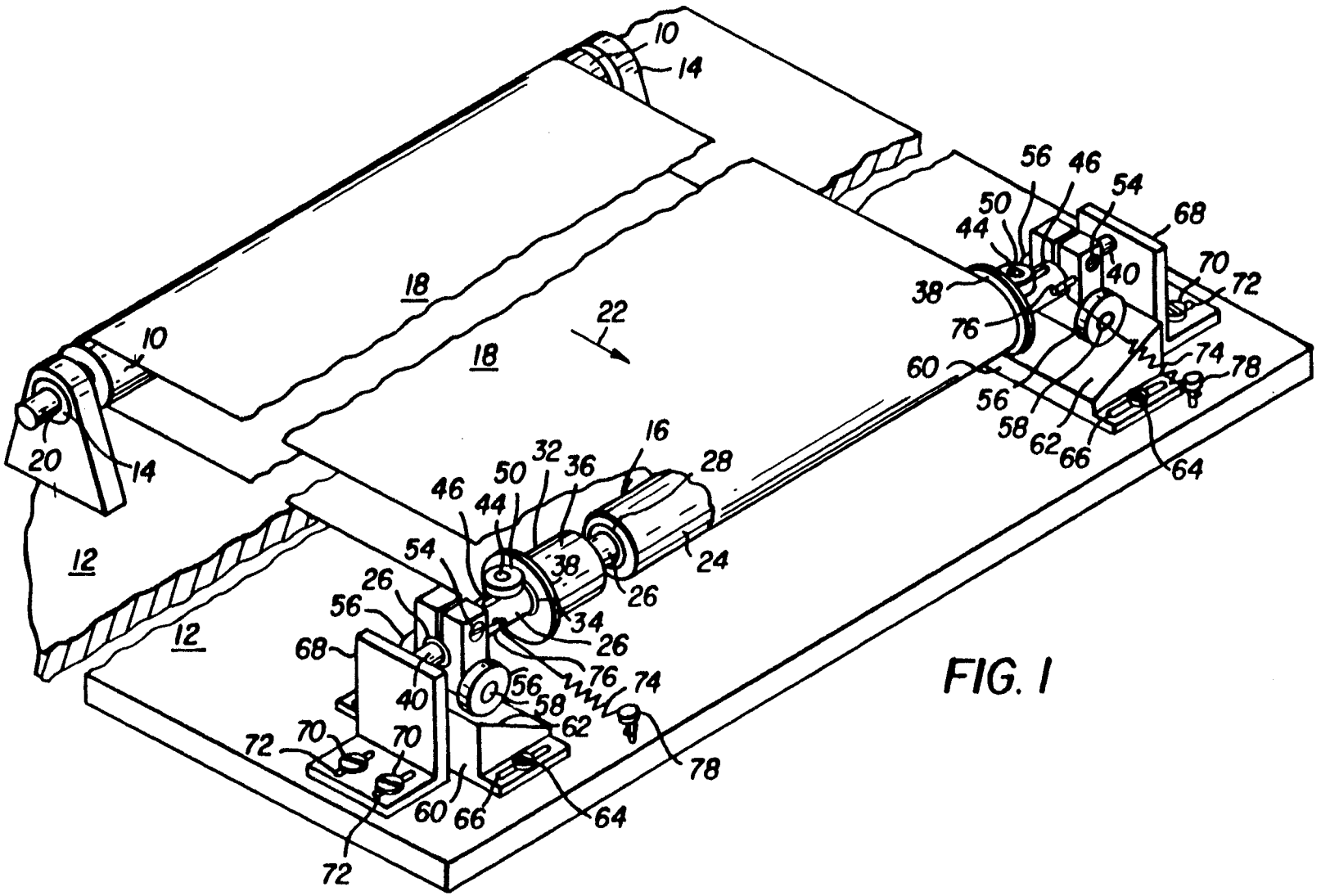
FIG. 1 is a fragmentary isometric view of a two roller web transport system including a mechanically operated web steering and tensioning mechanism according to a preferred embodiment of the present invention.

The illustrative preferred embodiment of the invention depicted in FIGS. 1 through 7 is shown in FIG. 1 in a web handling system of the type commonly employed in electrophotographic copiers. The web handling system comprises: drive roller 10, rotatably supported on base plate 12 by bearings 14; web steering and tensioning roller assembly 16, movably supported to plate 12 as described in detail below; and an endless web or belt 18 encircling the two rollers and wrapped partially around each roller. The drive roller is driven in a clockwise direction, as viewed in FIG. 1, by an appropriate motor drive device, not shown, connected to roller shaft 20, thereby causing the belt 18 to move in the direction shown by arrow 22.

Figure 2:
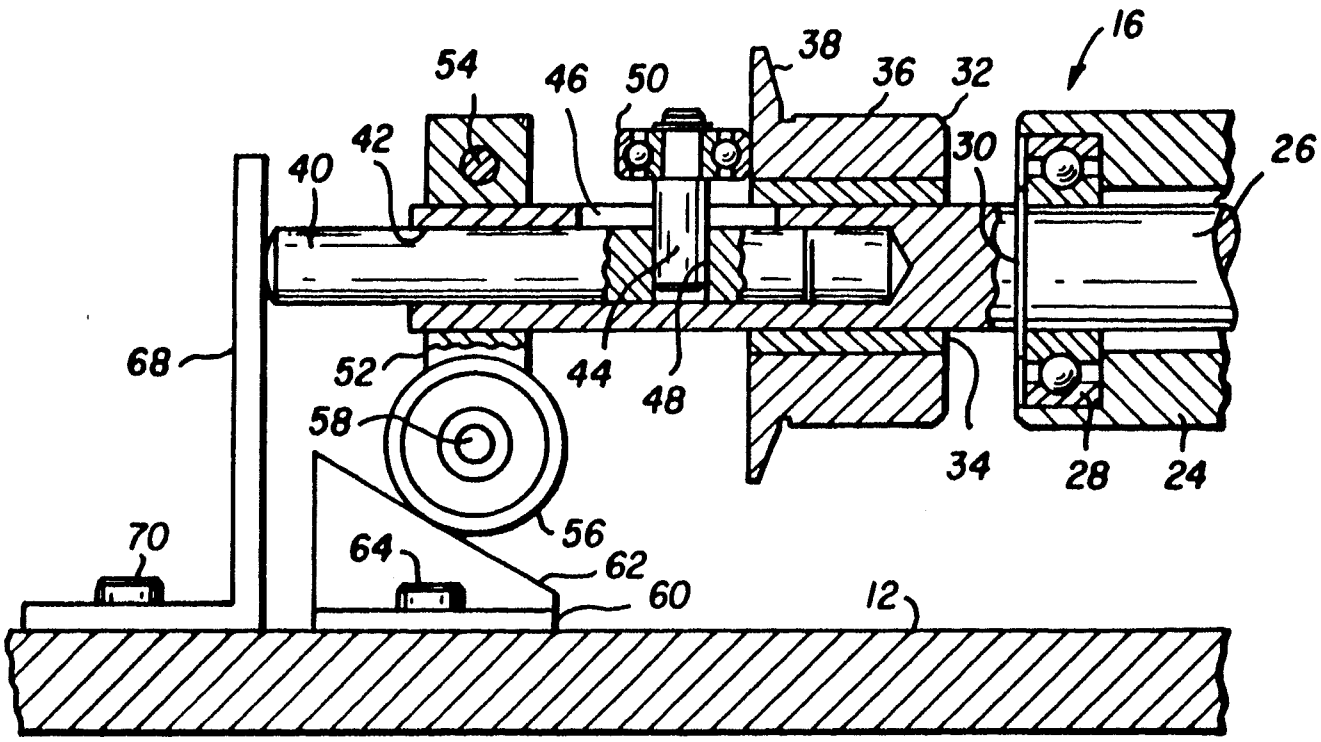
FIG. 2 is a longitudinal view, partially cross-sectioned, of the left end portion of the web steering and tensioning roller assembly depicted in FIG. 1.

As best illustrated in FIGS. 1 and 2, the web steering and tensioning roller assembly 16 comprises a steering and tensioning roller 24 rotatably supported in centered relation to shaft 26 by ball bearings located at each end of the roller inwardly of respective circle clips 30. Although FIG. 2 shows only the left end of roller assembly 16, it should be understood that the other end of the roller assembly is of identical but mirror-imaged construction. Two flange members 32 are slidably and rotatably supported by bushings 34 to shaft 26 adjacent the corresponding ends of roller 24. Each flange member includes a cylindrical portion 36, slightly smaller in diameter than roller 24, and an annular flange 38. At each end of shaft 26, an adjusting rod 40 is received in a corresponding axial bore 42. At each end of the shaft, a pin 44 extends through a shaft slot 46 and is secured in a hole 48 in the corresponding adjusting rod. Each of the two pins 44, in turn, carries a ball bearing flange follower roller 50.

Downward extending support bars 52 are clamped to the respective ends of shaft 26 by clamp screws 54 and each such support bar is provided with two ball bearing wheels 56, mounted coaxially to corresponding ends of axle pin 58, which extends through the bar at right angles to roller 24. A ramp member 60 is located on base plate 12 directly below each of the support bars with its sloped upper ramp face 62 engaged by the corresponding set of support bar wheels 56. The faces 62 of the ramp members slope downwardly toward each other and the ramp members are adjustably secured to base plate 12 by screws 64 extending through slots 66. Outwardly of each of the ramp members, an abutment member 68 is adjustably mounted to base plate 12 by screws 70 extending through slots 72, and serves to limit the endwise movement of the corresponding adjusting rods 40. Springs 74, extending between pins 76 on the support bars 52 and studs 78 on plate 12 bias the roller assembly 16 downwardly and away from the drive roller 10; thereby tensioning belt 18 and keeping wheels 56 firmly in contact with the corresponding ramp faces 62. Accordingly, wheels 56 prevent the roller assembly 16, as distinguished from roller 24, from rotating about an axis coaxial with or parallel to the axis of shaft 26, but the wheels can move omnidirectionally in contact with the ramp faces by rolling or sliding movement or a combination of both such types of movement.

The belt 18 is only very slightly narrower than the maximum space between the two flanges 38, which is established by the respective abutment members 68, As the belt 18 moves longitudinally in the direction shown by arrow 22, there will inevitably be slight inaccuracies that urge the belt to drift laterally in one direction or the other. If, for example, the belt is urged toward the left, as viewed in FIGS. 1–4, the edge of the belt will engage the annular flange 38 of the left flange member 32, rotatably and slidably mounted on shaft 26, and will move that member very slightly to the left until such movement of the flange member is blocked by the engagement of the outer face of the flange with the adjacent roller 50 and by the abutment of the corresponding adjusting rod 40 with the respective abutment member 68. When this occurs, the belt is prevented from drifting any further to the left and, therefore, an opposite or reactive force between the belt and roller 24 causes that roller to move endwise to the right. Because roller 24 is in fixed axial relation to support bars 52 and their wheels 56, but movable axially relative to adjusting rods 40, the movement of roller 24 toward the right causes the support bar wheels 56 likewise to move to the right relative to the corresponding ramp faces 62. Consequently, the roller assembly is caused to tilt-in a counterclockwise direction, as shown in FIG. 4. Because of the rolling contact between wheels 56 and ramp faces 62 when the roller assembly moves endwise or laterally with respect to the belt, the belt can apply sufficient force to the roller to effect the roller tilting movement without damaging the edge of the belt. This tilting movement, which is exaggerated in FIG. 4 for illustrative purposes, continues until it counteracts the tendency of the roller to urge the belt toward the left. Similarly, if the belt tends to drift to the right, its ultimate engagement with the right flange member causes the roller assembly 16 to tilt in a clockwise direction, thereby counteracting the rightward belt drifting. Accordingly, the lateral position of the belt is maintained substantially in a predetermined location, with any tendency to drift left or right resulting in corrective tilting movement of roller 24.

Figure 5:
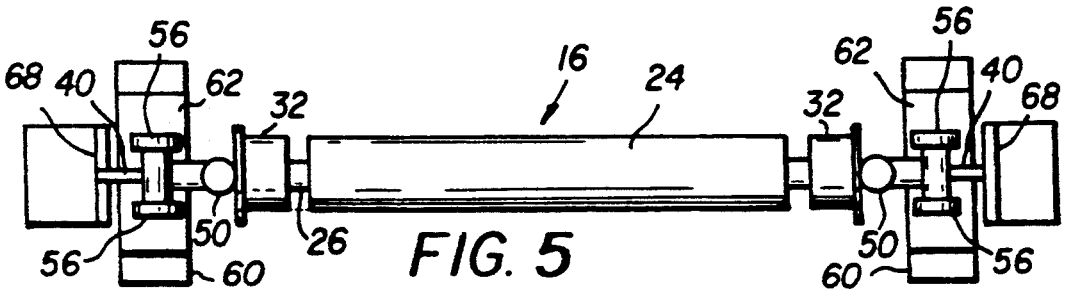
FIG. 5 is a somewhat schematic plan view of the steering and tensioning mechanism, showing the steering and tensioning roller substantially at right angles to the web path.
Figure 6:
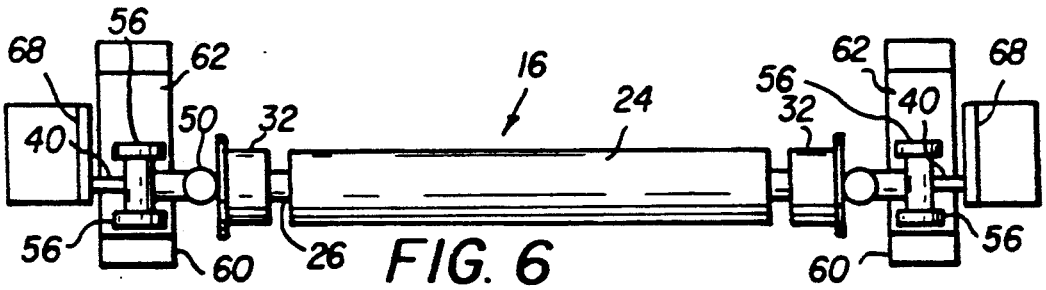
FIG. 6 corresponds to FIG. 5, but shows the roller translated in the direction in which it tensions the web.
Figure 7:
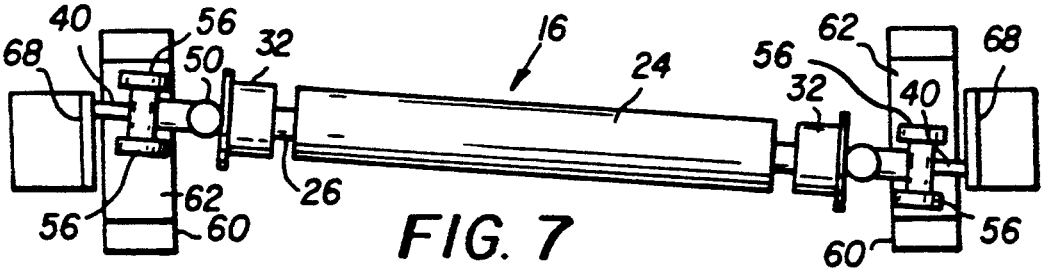
FIG. 7 corresponds to FIG. 6, but shows the roller rotated or skewed slightly in a clockwise direction to illustrate the manner in which it can apply tension uniformly across the web notwithstanding belt conicity.

FIG. 5 shows, in top view, the roller assembly 16 located at right angles to the ramp members 60 and displaced toward drive roller 10, i.e. in the position the roller assembly assumes if there is little or no belt conicity and the belt is relatively short. If the belt were to stretch or become slack for any other reason, springs 74 would move the roller assembly laterally of its axis, as shown in FIG. 6. Similarly, if belt conicity is present, the roller assembly is free to assume an angular or skewed position, as shown in FIG. 7, in which case the belt steering function is carried out as described above, while the angular position of the roller compensates for the conicity to insure that equal tension is imparted to the belt across its width.

Figure 3:
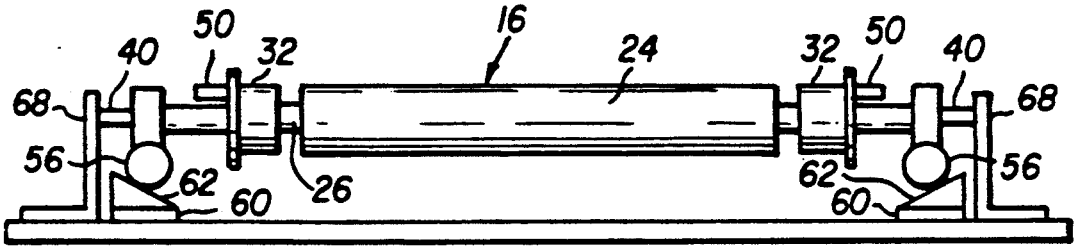
FIG. 3 is a somewhat schematic end elevational view of the front end of the device shown in FIG. 1, depicting the steering and tensioning roller in a substantially horizontal position.
Figure 4:
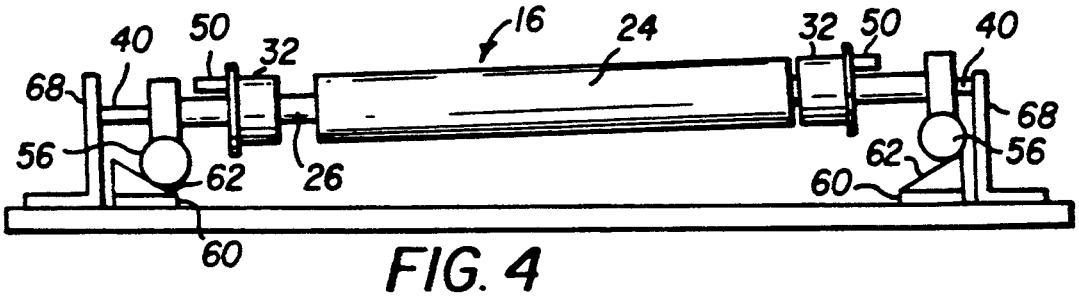
FIG. 4 corresponds to FIG. 3, but shows the roller tilted in a counterclockwise direction from its horizontal position.

It should be noted that, although the wheels 56 provide for substantially friction-free steering or tilting movement of roller assembly 16, e.g. between the positions shown in FIGS. 3 and 4, the roller assembly movements illustrated in FIGS. 5 through 8 require the wheels to slide or skid with respect to the ramp faces. However, whereas the belt can exert only limited steering or tilting force on the roller assembly because of the fragility of the belt edge, thus requiring low frictional resistance, springs 74 can exert substantial tensioning forces on the belt without danger of damaging it; thus avoiding the need for relatively friction-free engagement with the ramp faces insofar as the belt tensioning and conicity compensating movements of the roller assembly are concerned.

Although the ramp faces 62 are shown as being oppositely sloped but flat, these faces could be segments of a common cylindrical surface or of some other curved surface. If the belt runs in the direction opposite to arrow 22, the same steering and tensioning apparatus can be used simply by reversing the direction of slope of the ramp faces to cause the roller assembly to tilt in the opposite direction in response to the tendency of the belt to drift laterally, e.g. to tilt in a clockwise direction as viewed in FIGS. 3 and 4 in response to the belt being urged toward the left. Also, it should be noted that the locations of the wheels and the ramp members could be reversed, i.e. inverted ramp members could be carried by the roller assembly in engagement with stationary support wheels or the equivalent attached to the base plate.

Figure 8:
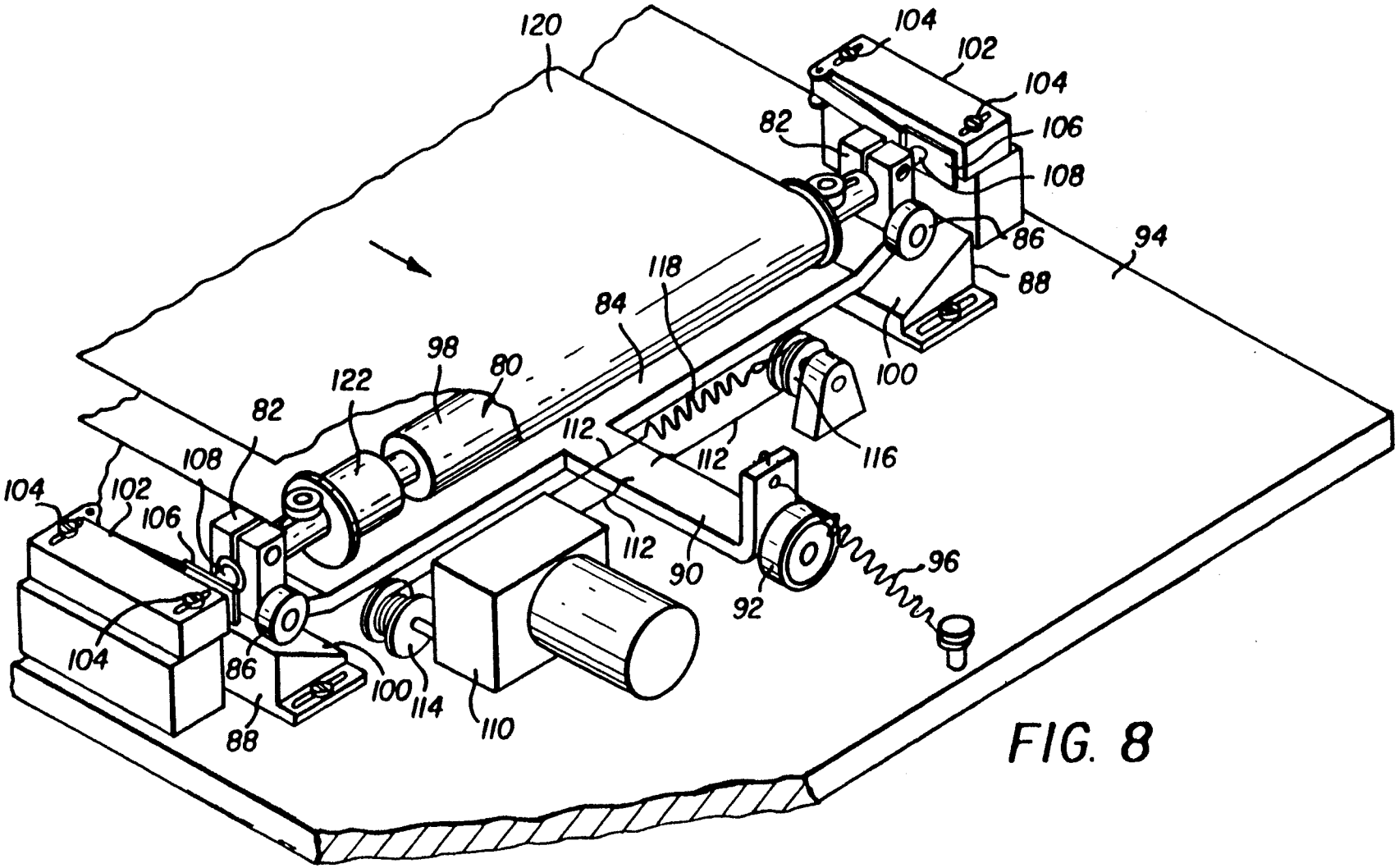
FIG. 8 is an isometric view similar to FIG. 1, but illustrates an alternate preferred embodiment of the invention in which the web steering and tensioning device is adjusted by an electrically operated sensing and adjusting system.

The alternative embodiment of the invention shown in FIG. 8 is generally analogous to the embodiment described above, but is adjusted by electrical means for belt steering purposes, The roller assembly 80 is very similar to the one previously shown and described, the principal differences being that the support bars 82 are joined by yoke member 84 and each carries only one wheel 86 rather than two wheels. Wheels 86 are engaged with corresponding ramp members 88, substantially identical to the above-described members 60. Tongue 90 of yoke member 84 is provided with a ball bearing wheel 92 riding on base plate 94 under the influence of tension spring 96. Accordingly, the roller assembly is constrained against rotating about an axis coaxial with or parallel to that of roller 98 by the one wheel 86 engaged with each ramp face 100 and a wheel 92 engaged with the plate 94, rather than by two wheels engaged with each ramp face.

At opposite ends of the illustrated roller assembly, normally open electrical switches 102 are adjustably supported to the base plate 94 by screws 104, with their respective switch blades 106 positioned adjacent the ends of the corresponding adjusting rods 108. Switches 102, in turn, control the direction of rotation of a gear reduction motor 110 mounted to base plate 94. A flexible cable 112 is attached to and wound around a drum 114 driven by motor 110, with one end of the cable attached to one side of yoke tongue 90. The other end of the cable passes around a rotatable pulley 116 and is connected to the opposite side of the yoke tongue 90. A spring 118 is installed in the cable between drum 114 and pulley 116 to maintain the cable in taut condition.

If the belt 120 drifts to the left, the resulting movement of the left flange member 122 causes the corresponding adjusting rod to close the adjacent left switch 100, thereby causing the motor to rotate drum 114 in a counterclockwise direction as viewed in FIG. 8. Accordingly, motor 110 causes the roller assembly to be pulled to the right and thereby tilted in a counterclockwise direction, until the resulting reversal of the lateral movement of the belt allows the left switch to open to terminate the rotation of motor When the rightward drifting movement of the belt causes the right switch 100 to close, the resulting clockwise rotation of motor drum 114 pulls the roller assembly to the left and thereby tilts it in a clockwise direction, thus again reversing the direction of lateral belt movement. Thus, the belt is maintained constantly within a path defined by the two switches 100.

The invention has been described in detail with particular reference to preferred embodiments thereof, but it will be understood that variations and modifications can be effected within the spirit and scope of the invention.

What is claimed is:

1. A web steering and tensioning device for a web handling apparatus having a base element and a rotatable web steering and tensioning roller adapted to support a longitudinally movable web wrapped partially around said roller, characterized by:

a ramp and support means, adjacent each end of said roller, for supporting said roller for movement about a steering axis and in a tensioning direction, one of said ramp and said support means being connected to said roller and the other to said base element, said ramps respectively having a surface engaged by a corresponding support means, said support means being movable in mutually perpendicular directions lying in a plane parallel to said ramp surface engaged thereby to provide for movement of said roller in such tensioning direction by which said web is uniformly tensioned and for tilting web steering movement of said roller in response to relative movement between said ramp and said support means in a lateral direction relative to said web, and means for restraining lateral movement of said web and imparting lateral movement to said roller in a direction opposite said lateral movement of said web to provide such relative movement between said ramps and said support means respectively.

2. The web steering and tensioning device of claim 1 wherein said support means includes wheel members engaged with said ramp to provide for relatively friction-free movement between said support means and said ramp in said lateral direction.

3. The web steering and tensioning device of claim 2 including at least three of said wheel members engaged with said ramp, whereby the engagement of said wheel members with said ramp surfaces constrains the assembly comprising said roller and said means connected thereto against rotation about an axis coaxial with or parallel to that of said roller.

4. The web steering and tensioning device of claim 1 including spring resiliently biasing said ramp means and said support means into engagement with each other.

5. The web steering and tensioning device of claim 4 in which said spring means also resiliently bias said roller to tension said web.

* * * * *